US008496058B2

(12) United States Patent
Davis

(10) Patent No.: US 8,496,058 B2
(45) Date of Patent: Jul. 30, 2013

(54) WELL FISHING METHOD AND SYSTEM

(75) Inventor: Albert P. Davis, Houston, TX (US)

(73) Assignee: Hydrus Corporation, Inc., Houston, TX (US)

( * ) Notice: Subject to any disclaimer, the term of this patent is extended or adjusted under 35 U.S.C. 154(b) by 0 days.

(21) Appl. No.: 13/568,910

(22) Filed: Aug. 7, 2012

(65) Prior Publication Data

US 2012/0298366 A1 Nov. 29, 2012

Related U.S. Application Data

(63) Continuation of application No. 12/645,070, filed on Dec. 22, 2009, now Pat. No. 8,261,829.

(60) Provisional application No. 61/229,601, filed on Jul. 29, 2009.

(51) Int. Cl.
*E21B 31/12* (2006.01)

(52) U.S. Cl.
USPC ..... 166/301

(58) Field of Classification Search
USPC ..... 166/301; 294/86.1–86.34
See application file for complete search history.

(56) References Cited

U.S. PATENT DOCUMENTS

| | | | | |
|---|---|---|---|---|
| 672,154 | A | 4/1901 | Taylor | |
| 1,362,883 | A | 12/1920 | McMillian et al. | |
| 1,599,067 | A * | 9/1926 | Segelhorst | 294/86.17 |
| 2,250,440 | A * | 7/1941 | Shannon | 294/86.21 |
| 3,895,837 | A | 7/1975 | Barnes | |
| 3,971,543 | A | 7/1976 | Shanahan | |
| 4,098,342 | A | 7/1978 | Robinson et al. | |
| 4,271,908 | A | 6/1981 | Robinson, Jr. et al. | |
| 4,506,729 | A | 3/1985 | Davis, Jr. et al. | |
| 4,537,250 | A | 8/1985 | Troxell, Jr. | |
| 4,537,435 | A | 8/1985 | Carver | |
| 4,580,826 | A | 4/1986 | Carver et al. | |
| 4,660,635 | A | 4/1987 | Wittrisch | |
| 4,840,230 | A | 6/1989 | Youd et al. | |
| 5,265,676 | A * | 11/1993 | Harrell | 166/301 |
| 5,549,163 | A | 8/1996 | Sieber | |
| 6,173,770 | B1 | 1/2001 | Morill | |
| 6,244,336 | B1 | 6/2001 | Kachich | |
| 6,736,209 | B2 | 5/2004 | Ivannikov et al. | |
| 6,776,233 | B2 | 8/2004 | Meehan | |
| 6,851,476 | B2 | 2/2005 | Gray et al. | |
| 6,942,035 | B2 | 9/2005 | Sollesnes | |

(Continued)

OTHER PUBLICATIONS

Bowen Tool, Inc., Instruction Manual, "Bowen Series 150 Releasing and Circulating Overshot" pp. 6-8.

(Continued)

*Primary Examiner* — Brad Harcourt
*Assistant Examiner* — Blake Michener
(74) *Attorney, Agent, or Firm* — Gordon T. Arnold; Arnold, Knobloch & Saunders, L.L.P.

(57) ABSTRACT

A well fishing method and system is described. In at least one example of the invention, a method of retrieval of material (e.g., a tubing string) having broken control or monitoring lines from a cased well is provided. The method comprises: isolating, from the well casing, broken lines above the material to be retrieved, thereby creating a substantially axial work passage; grasping the material to be removed through the substantially axial work passage; and pulling the material to be retrieved and the restrained lines from the well. Example shrouds, probes and other members are also described.

16 Claims, 13 Drawing Sheets

U.S. PATENT DOCUMENTS

| | | | |
|---|---|---|---|
| 7,096,951 | B2 | 8/2006 | Cox |
| 7,246,663 | B2 | 7/2007 | Rose |
| 7,249,637 | B2 | 7/2007 | Hayes et al. |
| 7,299,885 | B2 | 11/2007 | Baird |
| 7,357,183 | B2 | 4/2008 | Gazewood |
| 2004/0003923 | A1 | 1/2004 | Sollesnes |
| 2004/0262005 | A1 | 12/2004 | Harmon et al. |

OTHER PUBLICATIONS

"Tech Facts Engineering Handbook" of Baker Oil Tools,(1995) pp. 4-1 through 4-21.

File History of co-pending European Patent Application No. 10170821.2, 32 pages, Jul. 26, 2010.

* cited by examiner

WELL FISHING METHOD AND SYSTEM

RELATED APPLICATIONS

This application is a continuation of U.S. patent application Ser. No. 12/645,070, filed Dec. 22, 2009 now U.S. Pat. No. 8,261,829, which claims priority to U.S. Provisional Application No. 61/229,601, filed Jul. 29, 2009, all of which are incorporated herein by reference for all purposes.

BACKGROUND

This invention relates to the recovery of materials from well bores, and more specifically from cased well bores. Sometimes such operations are referred to as "fishing."

In the oil and gas exploration and production industry, well bores are drilled and then cased with metal pipes, generally called "casing" or "liners," that are cemented into the ground. In this document, the term "casing" shall include "liner," and a "cased" well shall include a "lined" well. An additional string of smaller diameter pipes, called a completion string, are installed inside of the casing strings for the function of safely transporting fluids to or from the geological zone of interest or formation. One of the principle functions of a completion string, or tubing, is to isolate the inner casing string(s) from formation pressure and formation fluids. The tubing typically establishes fluid flow with the formation through perforations created in the section of casing or liner below a production packer that seals around the lower end on the completion string. The perforation holes are usually "shot" through the casing or liner such that they penetrate the geologic zone of interest for hydrocarbons to flow into the cased hole below the packer and into the tubing string. Pumps or other equipment may be placed in the cased hole at various times, for isolation of different production zones, rework of the well, and for other operations. During any of those operations, a break in the tubing string hanging in the cased hole can cause a large amount of equipment to drop, and that equipment needs to be "fished" out of the hole.

In modern wells, more and more of the completion string equipment in the hole is controlled or monitored from the surface with control and or monitoring lines. Whether hydraulic, electric, fiber optic, chemical injection, or something else, when a component of a completion string (usually metal) that is supporting the string weight breaks and a portion or the entire string falls, the control/monitoring lines break, also.

An example is seen in FIG. 1 (not to scale). There, a subsea well head 110 ("Christmas tree" not shown) is seen mounted to sea-floor 112 under water 114. In the illustrated example, a tubing hanger 116 is mounted in wellhead 110. Also shown are vent sub 118, chemical injection sub 120, and SCSSV 122 (standing for Surface Controlled Subsurface Safety Valve). The above reside on a 5½ inch tubing 124 that connects to 7 inch tubing 126 and eventually to 6⅝ inch tubing 128. The components in FIG. 1 are highly compressed (vertically) as illustrated; those of skill in the art will recognize that, in reality, cross-over connections and different spacing than seen in FIG. 1 exist in the field.

Referring still to FIG. 1, asphaltene injection sub 130, DHP&TG (standing for Down Hole Pressure and Temperature Gauge) 132, and DHP&TG 134, are connected below on 5½ inch tubing 136 and are interconnected with 6⅝ inch tubing 128 and packer 140 (as is understood by those of skill in the art).

The completion string described above resides inside an 11¾ inch casing 142 secured by means that are not shown (but understood by those of ordinary skill) to wellhead 116 and seafloor 112. Casing 142 is connected by cross-over 144 to 9⅞ inch casing 146. Annulus 148 includes fluids that will occur to those of skill in the art.

Referring now to FIG. 2, the area showing sub 118, sub 120, and SCSSV 122, all of FIG. 1, has been illustrated in more detail. Also seen in FIG. 2 are various control/monitoring lines 212 that operate those devices and, in some embodiments, components below the packer 140. Although still not to scale, some of the possible relative distances between components is seen; for example, vent sub 118 includes 7 inch tubing 214 above and below. The sizes of the tubing sections and the subs or other controlled/monitored devices is not of significant importance for purposes of the present invention but are given by way of illustration to show the types of components and lines in wells related to it. No particular component or type of line is critical to the invention, nor is any combination.

Referring now to FIG. 3, the same string from FIG. 1 is seen in which a break 210 is seen in tubing 124. The control/monitoring lines are not shown.

In FIG. 4, the area shown in FIG. 2 is seen where the failure in tubing 124 has caused control/monitoring lines 212 to break.

Traditionally, in wells that do not include such lines, some form of tool is used to grasp the "fish" and it is pulled out. However, in the presence of the lines 212, the pulling causes a tangle between the lines and the casing. This interference will increase drag and the force needed to pull the equipment out of the well.

In at least some cases, the lines and the hardware used to attach them securely to the completion string have packed-off the annulus area to a degree that the fishing operation will have to be abandoned.

This causes a great many problems. For example, in some cases, an unsuccessful fishing operation means that the well bore must be abandoned—at a cost of many millions or even hundreds of millions of dollars if a replacement well is required. Even worse, while fishing operations are underway, offshore rigs are literally tied to the well bore. It takes a lot of time to shut down a well and secure a rig in the event of a hurricane. If the rig has become stuck, too long, the entire structure can be lost.

Therefore, there is a great need to improve the efficiency and the effectiveness of removal of materials from well bores.

SUMMARY OF EXAMPLES

In at least one example of the invention, a method of retrieval of material (e.g., a tubing string) having broken control or monitoring lines from a cased well is provided. The method comprises: isolating, from the well casing, broken lines above the material to be retrieved, thereby creating a substantially axial work passage; grasping the material to be removed through the substantially axial work passage; and pulling the material to be retrieved and the restrained lines from the well.

In a further embodiment, the method also includes isolating, from the substantially axial work passage, the broken lines above the material to be retrieved.

In a slightly more specific example, the isolating from the well casing of the broken lines comprises placing a shroud over the material to be retrieved, wherein the shroud, alone or in combination with a work string to which it is attached, is at least as long as the broken lines above the material to be retrieved. In a further example, the isolating from the substantially axial work passage of the broken control lines comprises inserting an inner shroud inside the outer shroud, wherein an annulus is defined between the inner shroud and the outer shroud of a length sufficient to isolate broken lines that reside above the material to be retrieved wholly within the annulus. This example permits the entry of typical fishing tools access to the bore of the material to be retrieved such that operations can be efficiently conducted without interference of the control lines above the material to be recovered. This example also comprises, inserting an extracting tool through the inner shroud and removing the material to be retrieved, the outer shroud, the inner shroud, and the lines, together.

In at least one, more specific example, the isolating comprises: lowering, into the well, a shroud having a lower splayed end, wherein the outer diameter of the splayed end is sized to the inner diameter of the casing of the well and the smallest lines such that the gap between the casing and the splayed end is less than the thickness of the smallest control or monitoring line; rotating the lower splayed end (in at least one example, in cyclic oscillating motion between over about 180 degrees) at least a portion of the time when the lower splayed end is in contact with an the control or monitoring lines; covering at least a portion of the material to be retrieved with the shroud, and resting the shroud on the material to be retrieved. In some cases, the shroud comprises a single device that is at least as long as the length of the broken wires extending above the tool. In further examples, however, the shroud includes an extension member that is attached above a lower portion of the shroud, to allow for sufficient length. The shroud, in all of its possible physically configurations, must be of adequate mass such that any well bore circulation of fluids will not be capable of raising the shroud off its seated and centralized orientation on the top of the material to be removed from the well bore. A further requirement of the shrouds is that, once seated on the top of the material to be removed, it shall be free from restrictive interference with the fixed: casing ID, wellhead, Christmas tree, and/or any other fixed well bore structure that the shroud may contact other than the material to be retrieved, such that the shroud is free to move in unison with the top of the material to be retrieved should this material experience any changes in its length during the coarse of fishing activities.

In a further example of the invention, a system of retrieval of material from a cased well is provided, the system comprising: means for isolating, from the well casing, broken lines above the material to be retrieved, thereby creating a substantially axial work passage; means for grasping the material to be removed through the substantially axial work passage; and means for pulling the material to be retrieved from the well.

In a further example, the system also comprises means for isolating, from the substantially axial work passage, the broken control lines above the material to be retrieved.

In a slightly more specific example, the means for isolating the broken lines from the casing comprises a generally cylindrical shaped member having substantially-radially-projecting members in the interior. Those members centralize the cylindrical shaped member with material to be removed and provide a positive stop for the cylindrical shape. In some cases, the positive stop comprises a first landing surface on at least one of the substantially-radially-projecting members wherein the first landing surfaces faces, at least in part, toward the tapered opening. In further example, there is a tapered surface on at least one of said substantially-radially-projecting members extending from the inner diameter of the substantially cylindrical shaped member to the landing surfaces. In still further examples, there is a second landing surface on at least one of the substantially-radially-projecting members, wherein the second landing surface faces, at least in part, the threaded opening.

In many examples, the cylindrical shaped member will have a tapered or "splayed" opening on one end and a threaded opening on the other for connection to a work string. In some such examples, the splayed open end includes slots for engagement with lines to direct then interiorly. Also, in some examples, there will be at least one guide surface located on the outside of the generally cylindrical shaped member between the threaded opening and the tapered opening, to guide the cylindrical shaped member as it descends in the well bore. Further examples include a substantially-radially facing surface on the substantially-radially-projecting members to engage a tapered probe-body that has at least one passage for allowing circulation fluid to circulate in the well and a solid end for deflection of lines. In some such examples, a shroud is detachably connected to the tapered probe (for example, with shear pins), and the tapered probe includes a connection end that includes a fluid circulation opening for connection with a work string.

In some examples, the means for grasping includes a grapple that is inserted through an axial work passage formed inside between the cylindrical shaped member into the material to be recovered (for example, an exposed opening the a material to be recovered), and the means for pulling the material to be retrieved from the well comprises the work string attached to the grapple. In some such examples, the axial work passage is formed through an inner shroud probe. Several means for grasping include; internal grapples, internal fishing spears, threading into a coupling present on the material to be recovered, threading onto a male threaded pin present on the material to be recovered, latching into an internal profile inside the tubing string, and even an external (for example, in the situation in which an outer shroud lands on a portion of the material to be removed that is lower but of a larger diameter than the broken portion.

DETAILED DESCRIPTION OF EXAMPLES OF THE INVENTION

Figure 1:
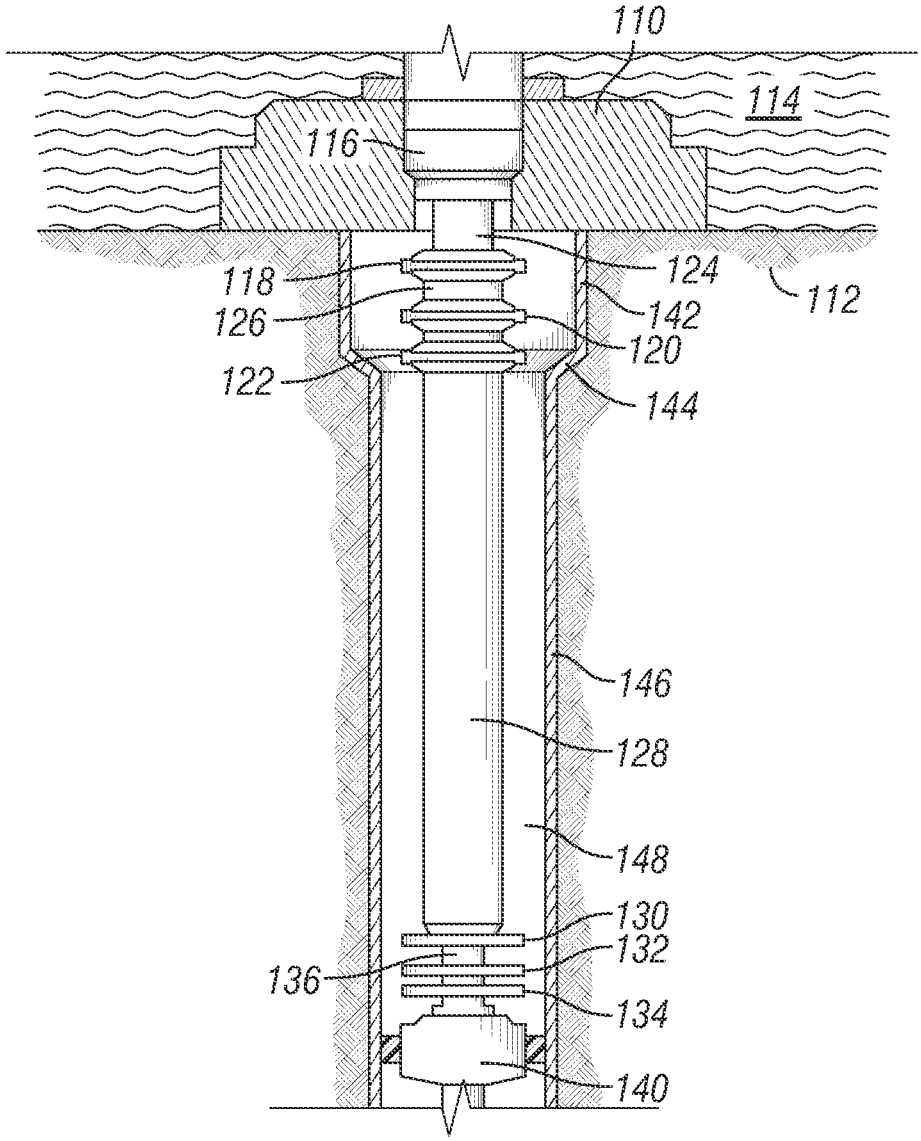
FIG. 1 is a side view of a cased well pertaining to the invention.
Figure 2:
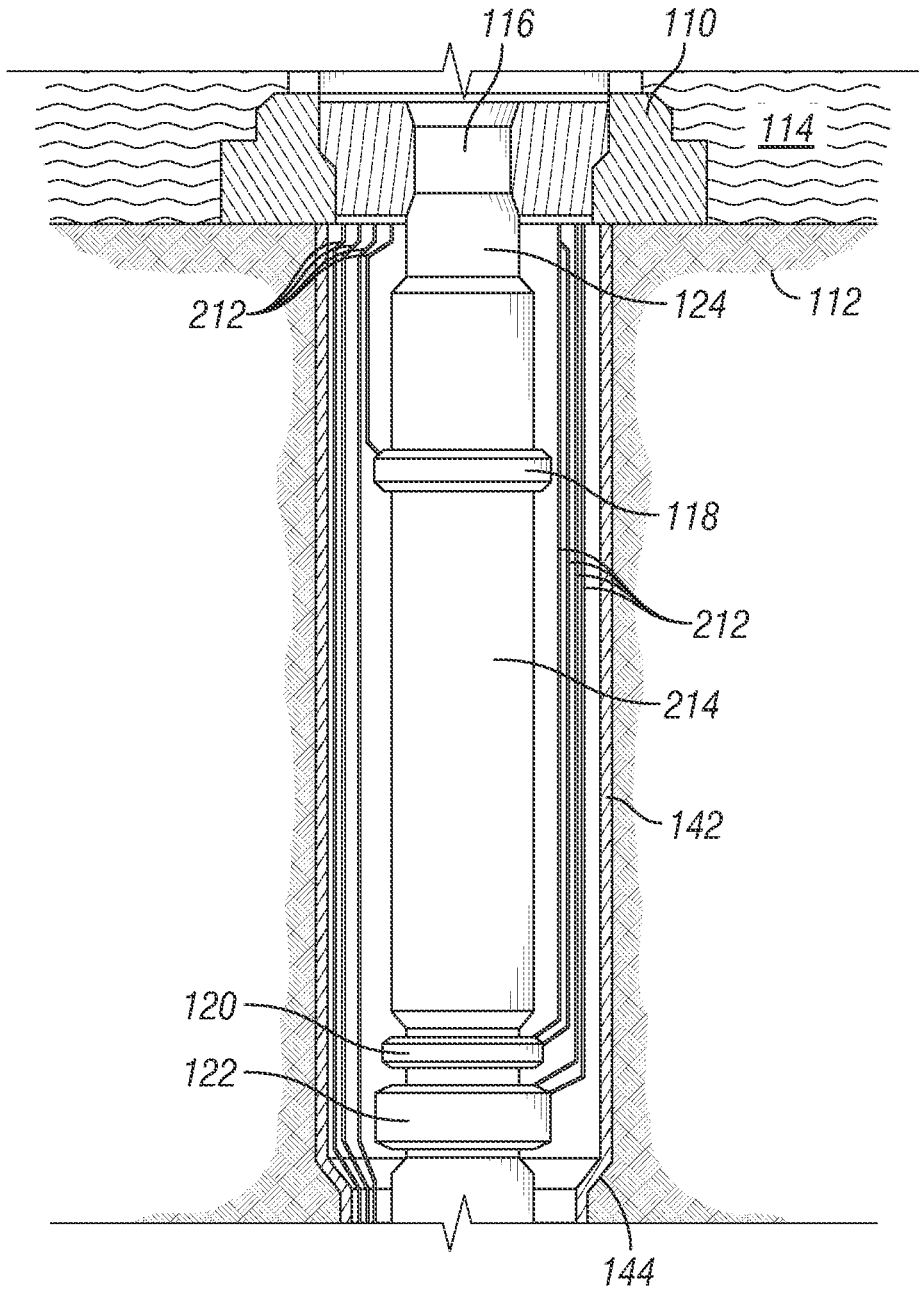
FIG. 2 is a side view of a portion of the cased well of FIG. 1.
Figure 3:
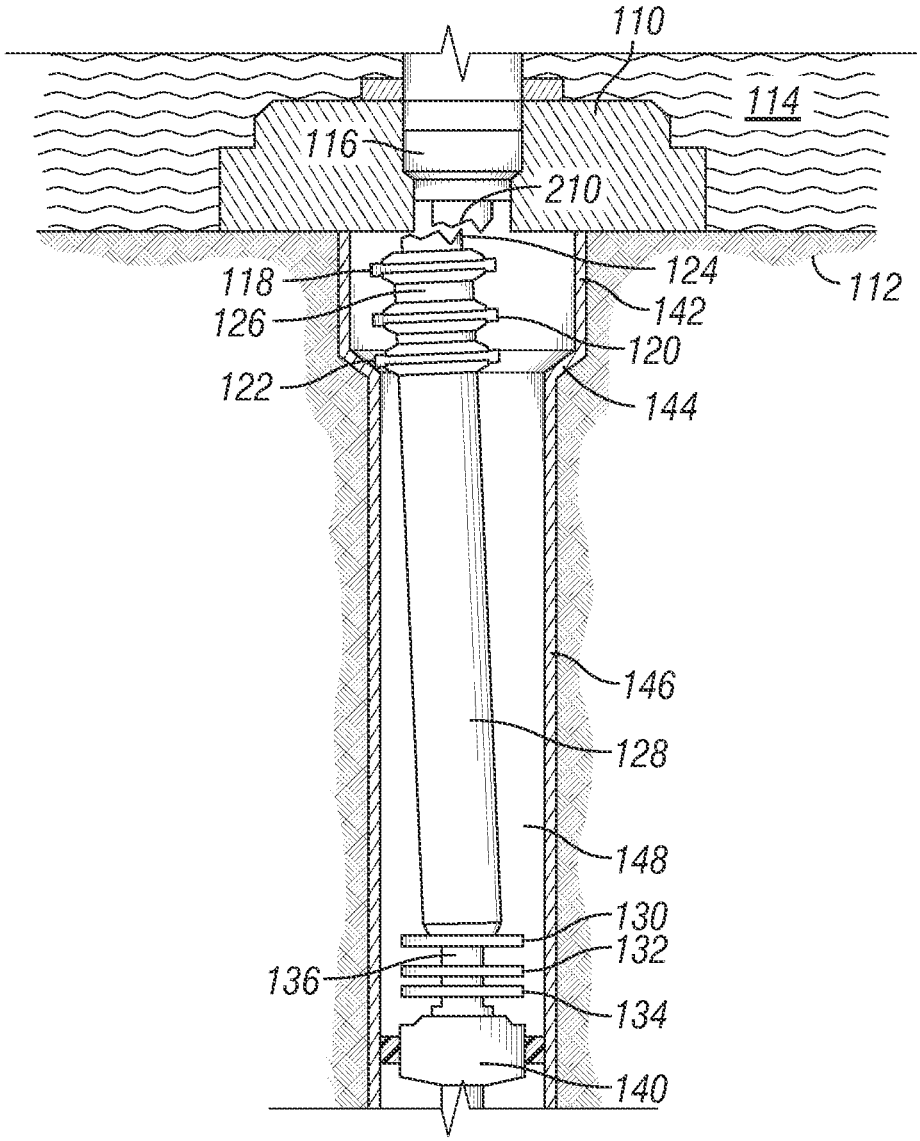
FIG. 3 is a side view of a cased well pertaining to the invention.
Figure 4:
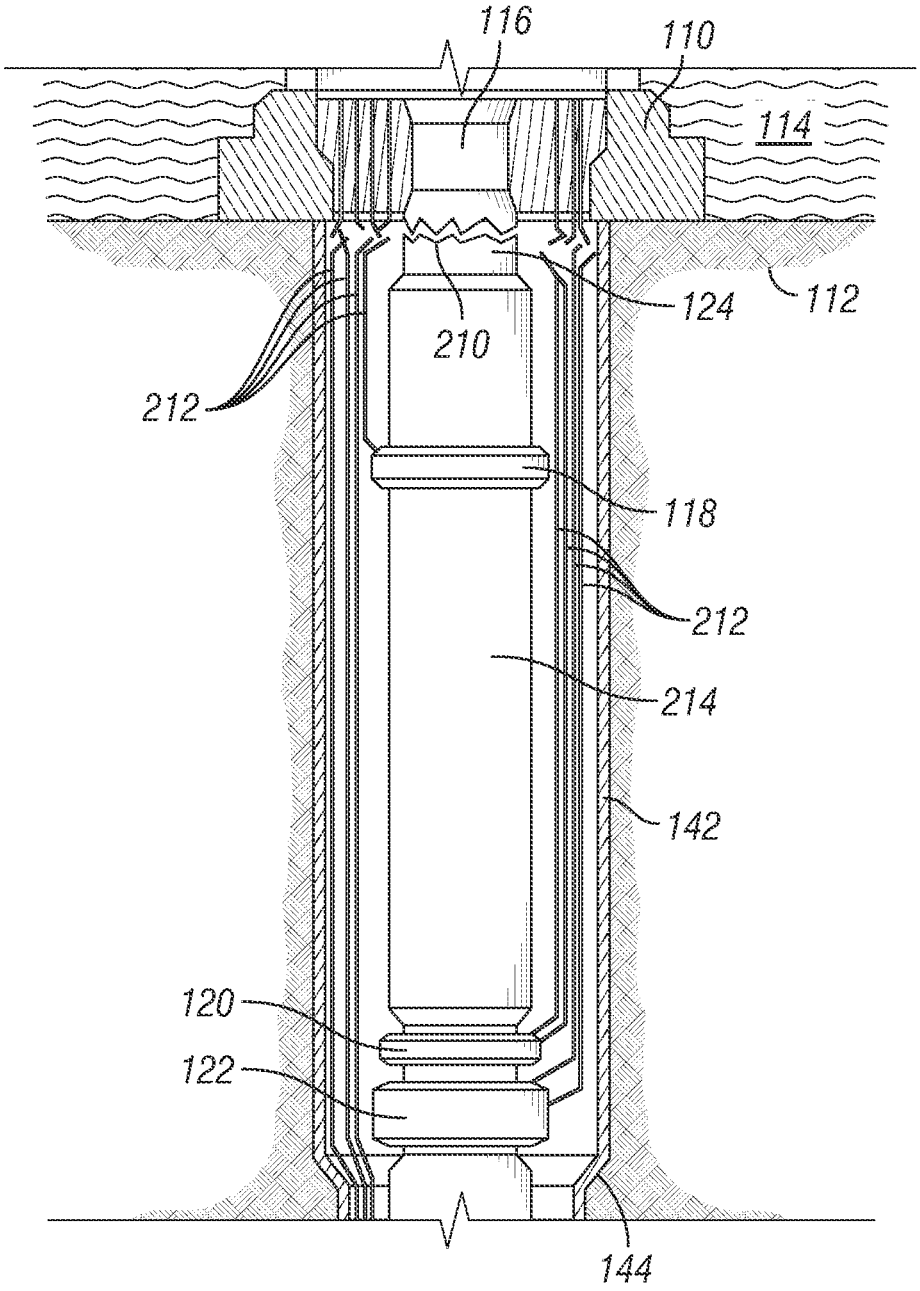
FIG. 4 is a side view of a portion of the cased well of FIG. 3.

In the drawings and description that relates to them, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms.

Specific embodiments are described in detail and are shown in the drawings, with the understanding that the present disclosure is to be considered an exemplification of the principles of the invention; it is not intended to limit the invention to that illustrated and described. The different teachings of the embodiments discussed below may be employed separately or in any suitable combination to produce desired results. The various characteristics mentioned above, as well as other features and characteristics described in more detail below, will be readily apparent to those skilled in the art upon reading the following description and by referring to the accompanying drawings.

Figure 5:
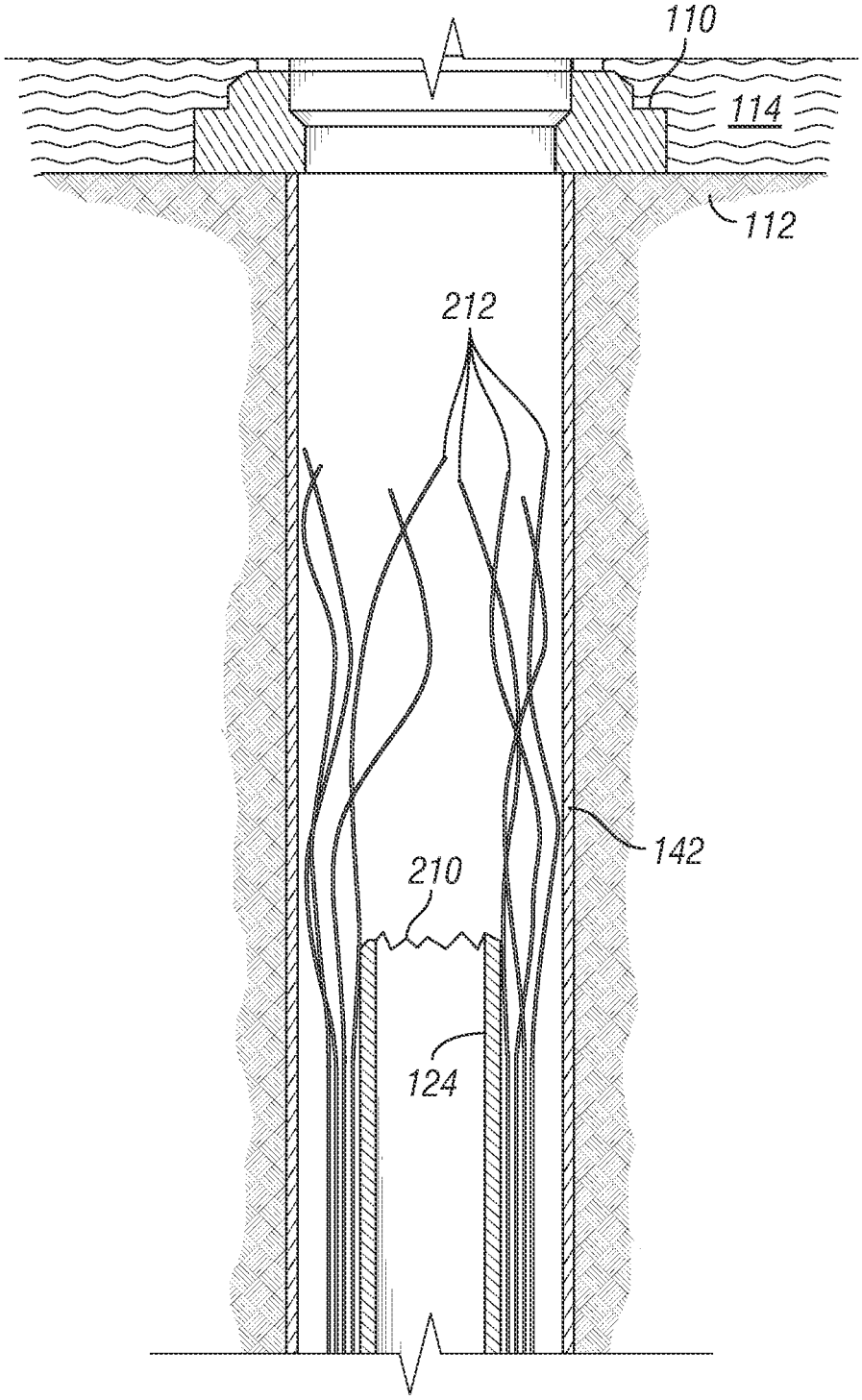
FIG. 5 is a side view of the well of FIG. 4, in which a portion of the apparatus in the well has been removed.

In FIG. 5, the area of tubing failure 210 is seen with the hanger and tubing above the failure removed. The lines 212 are seen above failure 210 and represent the challenge of extracting the assembly below the failure 210 (sometimes referred to as the "fish").

Figure 6:
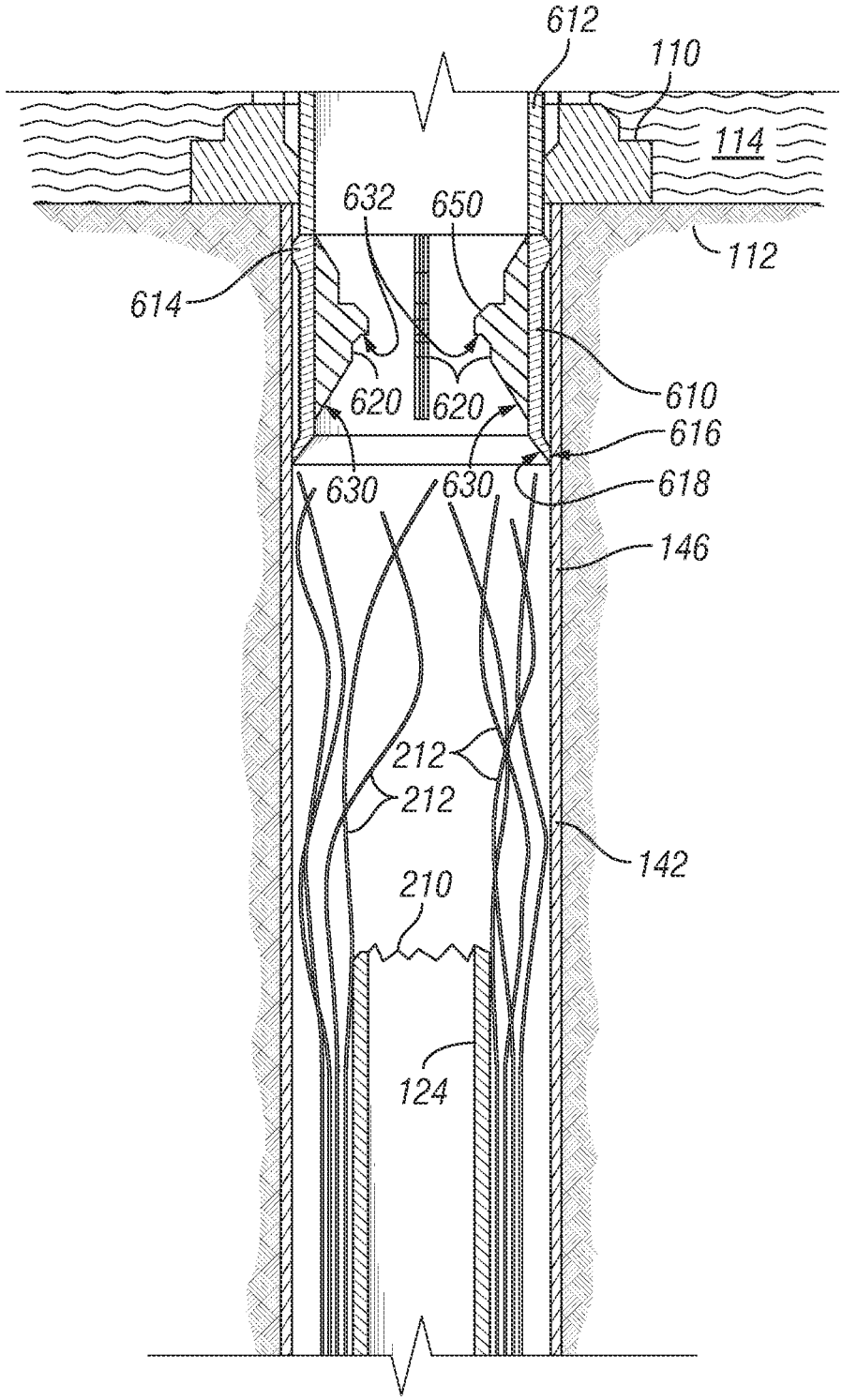
FIGS. 6-13 are side of the well of FIG. 4, in which steps and structural elements pertaining to various examples of the present invention are illustrated.

Referring to FIG. 6, a shroud 610 is lowered on work string 612, contacting the inner wall of casing 142 at upper guides 614 and lower guides 616 on flared lower opening 618. Four members 620 are situated about 90 degrees apart around the shroud 610 to engage failed tubing 124 (as explained in more detail, below).

Figure 7:
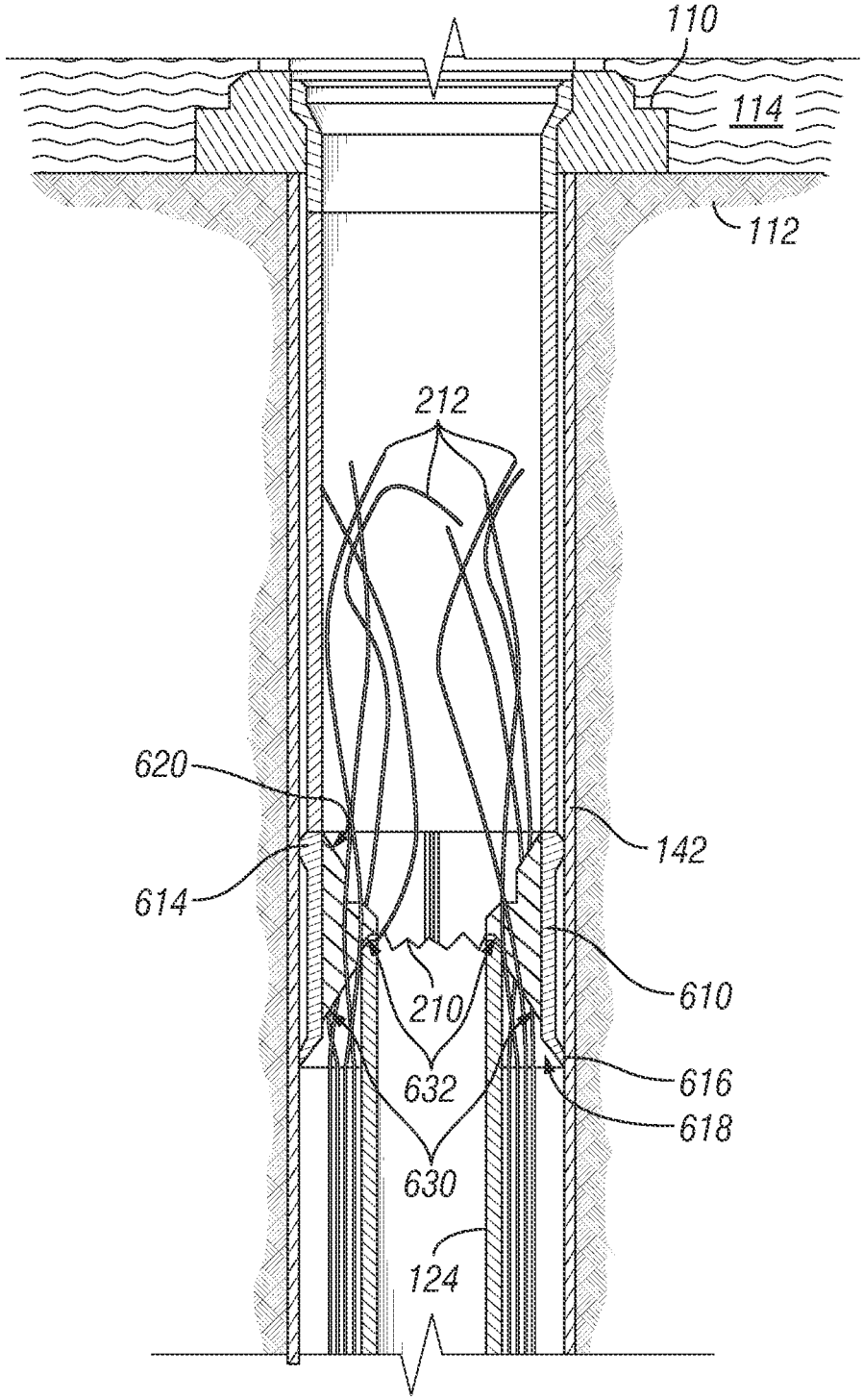

In FIG. 7, as shroud 610 is lowered past the breaks in lines 212, shroud 610 is rotated so that any of lines 212 engaging lower guide 616 will, rather than compress significantly, be directed to the interior of shroud 610. Shroud 610 is sized to be as close fitting as possible to the inner diameter of casing 142 to prevent broken lines 212 from becoming lodged between shroud 610 and casing 142. An acceptable outer diameter of lower opening 618 is one that leaves less space between lower guide 616 and the inner wall of casing 142 than the diameter of the smallest of lines 212.

Referring again to FIG. 6, members 620 have centralizing surfaces 630 that, when initially contacting tubing 124, guide it toward the center of casing 142. Members 620 also have landing surfaces 632, for engagement with tubing 124, as best seen in FIG. 7.

Figure 8:
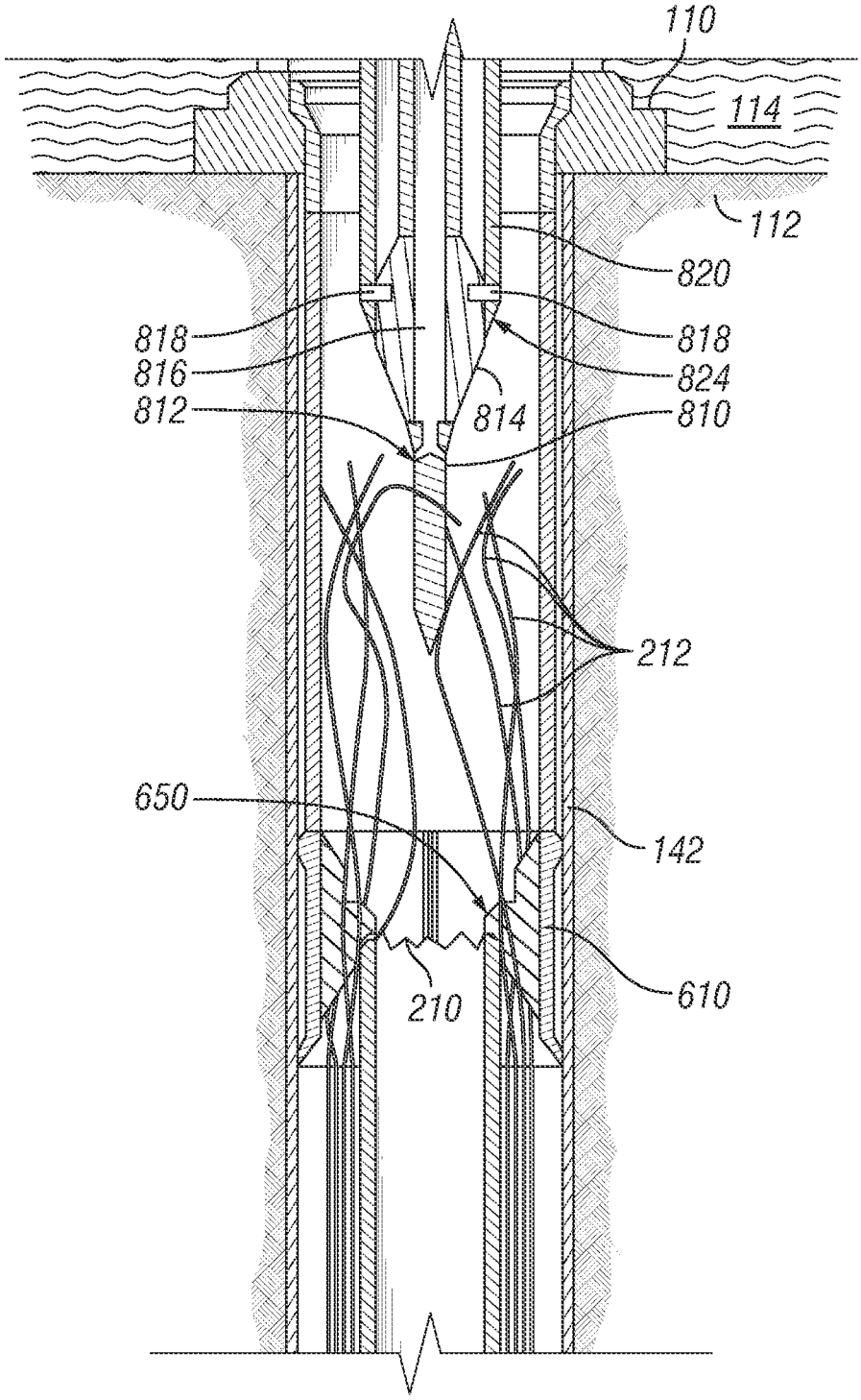

As seen in FIG. 8, a probe 810 is then inserted into casing 142, past lines 212. Probe 810 includes circulation ports 812 to allow for fluids to be pumped during insertion, and it is attached to tapered, inner-shear member 814, which includes circulation passage 816 that connects to the surface (not shown). The smooth, tapered shape reduces the chance of hanging on or snagging any of lines 212. Shear pins 818 connect tapered, inner-shear member 814 to inner shroud 820.

Figure 9:
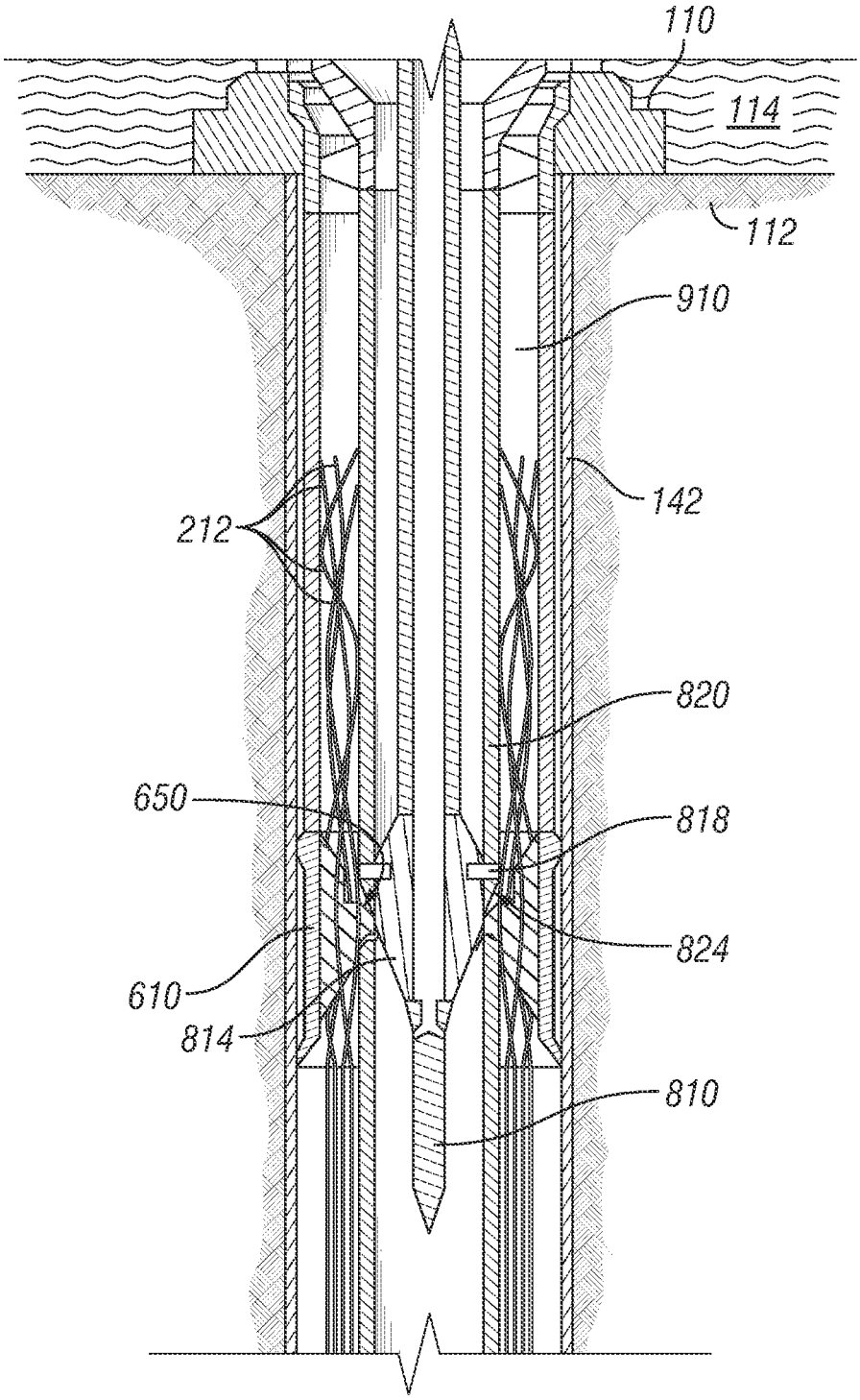

As seen in FIG. 9, probe 810 is inserted past lines 212, and tapered, inner-shear member 814 guides the lines 212 past the tapered landing ends 824 of inner-shroud 820. Ends 824 land on inner shroud landing surfaces 650. At this point, lines 212 are isolated in an annulus 910 between shrouds 610 and 820.

Figure 10:
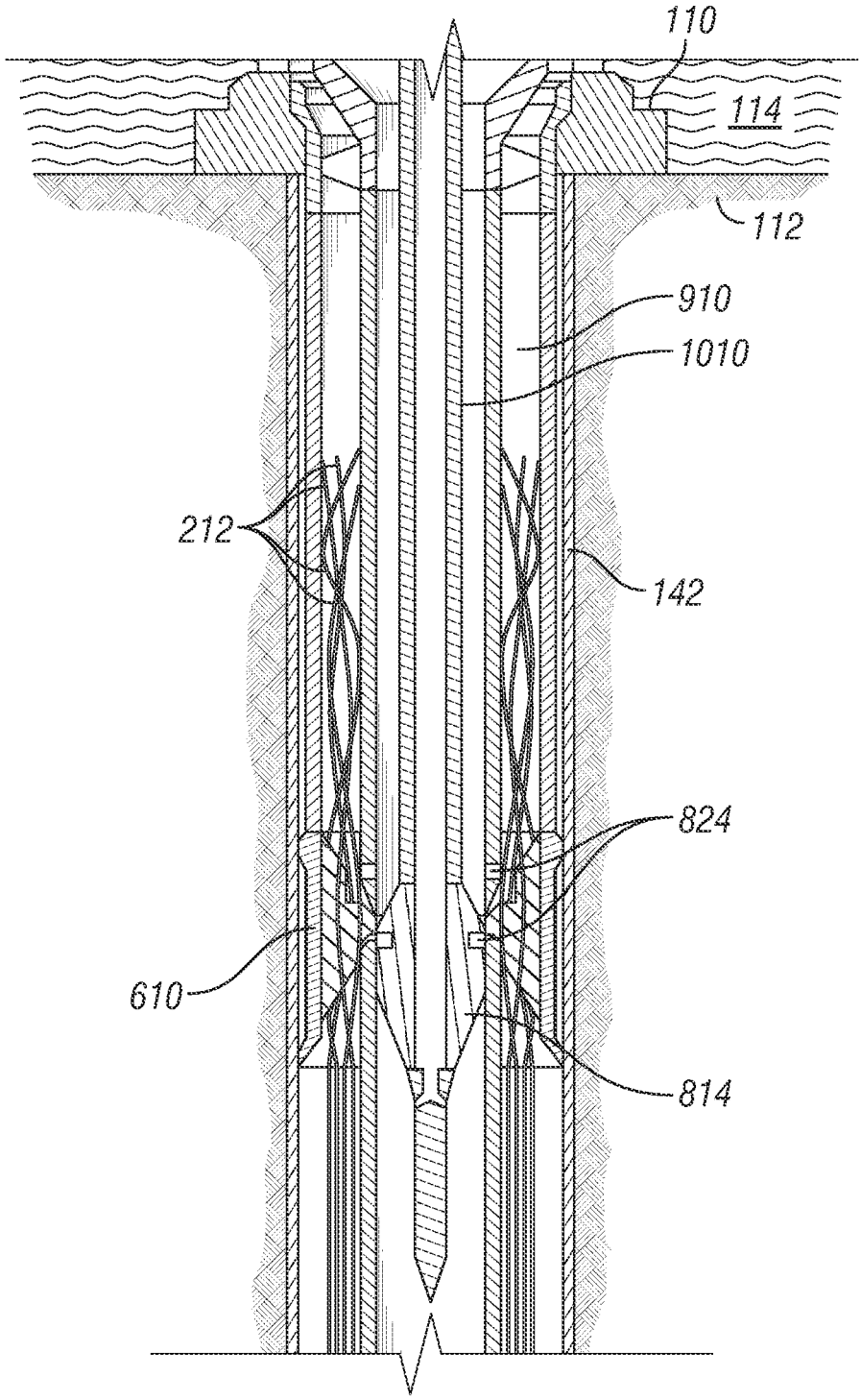

In FIG. 10, work string 1010 is forced down onto tapered member 814, shearing pins 824.

Figure 11:
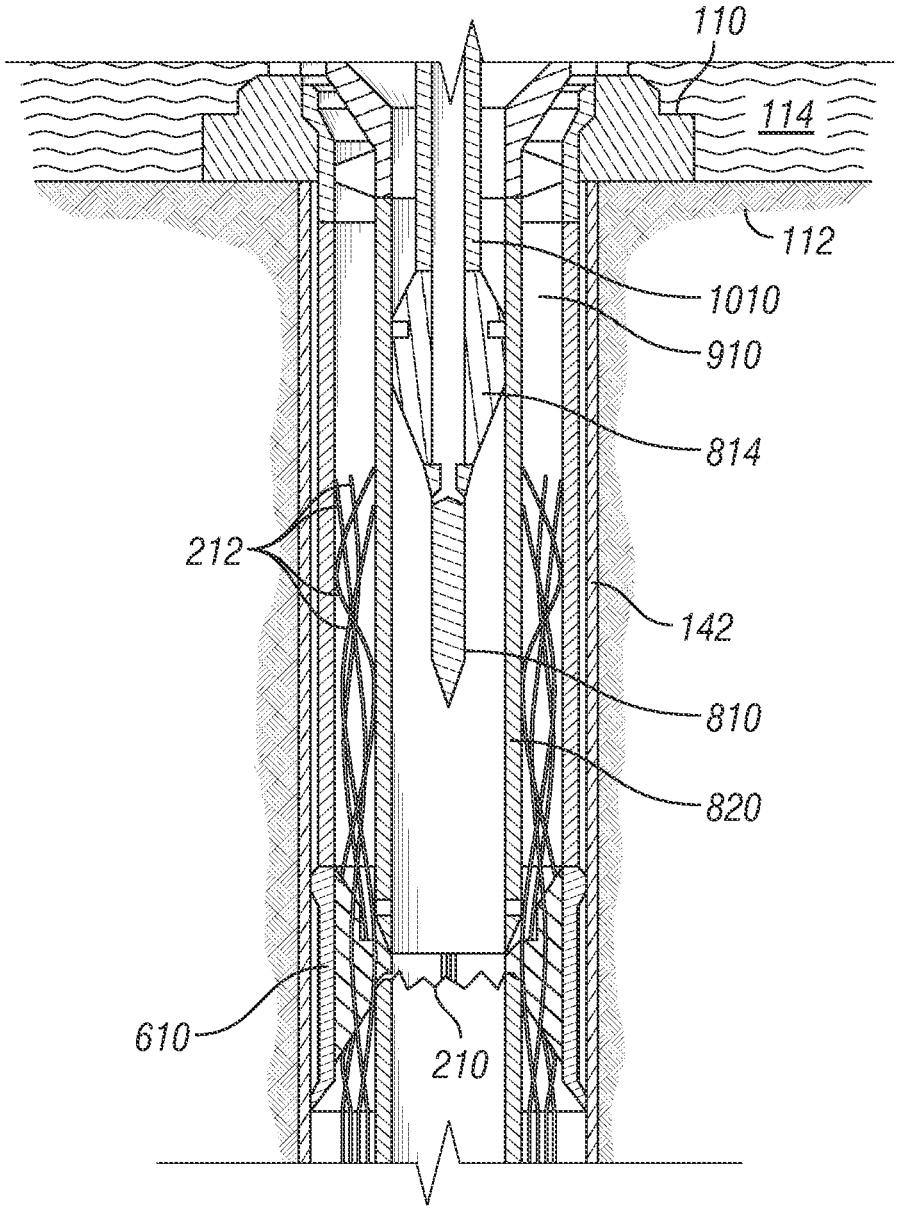
Figure 12:
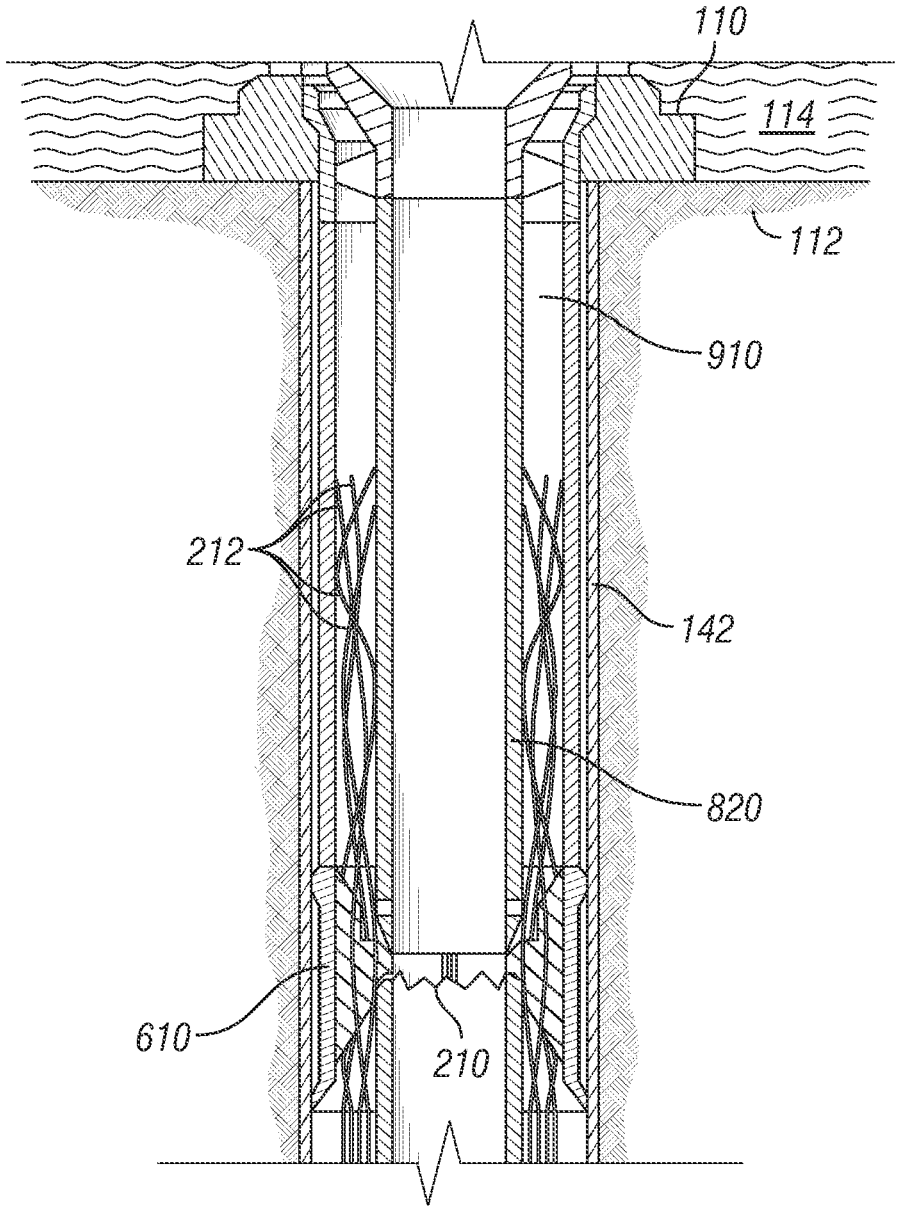
Figure 13:
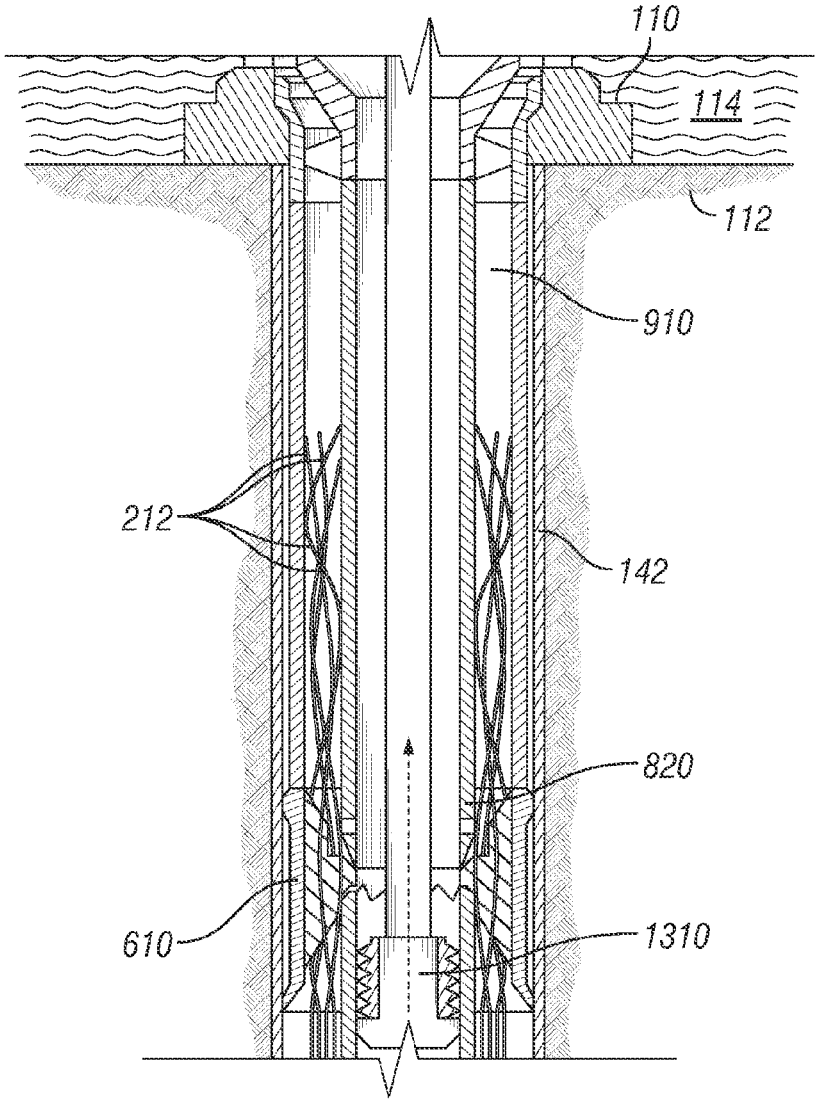

FIGS. 11 and 12 illustrate removal of probe 810, tapered member 814 and work string 1010, leaving inner shroud 820 resting on shroud 610, still isolating lines 212 in annulus 910. Through the clear and substantially aligned tubing conduit, traditional recovery operations can be performed below the broken lines 212. For example, as seen in FIG. 13, a recovery tool 1310 (commonly known in the art—here, an internal grapple) is inserted into the fish, which is then removed with the shrouds 610 and 820, maintaining lines 212 in annulus 910 during removal, thus preventing the tangles and removal problems of the prior art.

Figure 14:
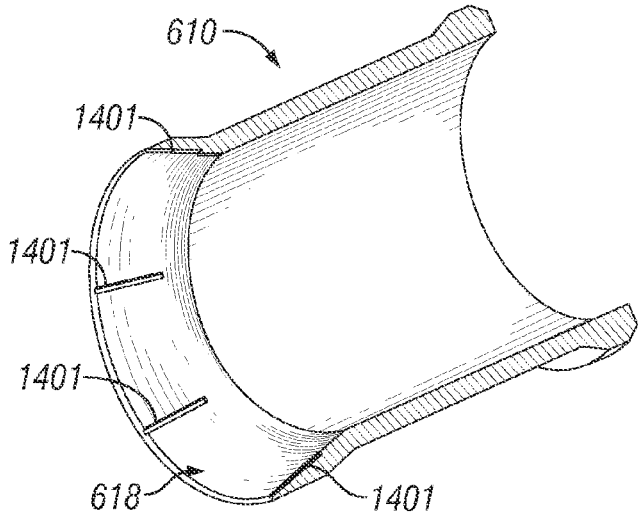
FIG. 14 is an end view of an example of a shroud useful in the retrieval of material from a well.

Referring now to FIG. 14, a detail view of and example of shroud 610 is seen in which interior slots 1401 are included in the lower opening 618. As illustrated, interior slots 1401 are about ¼ inch wide, and in various embodiments, run from the end of opening 618 about half way to ¾ of the way up the taper of lower opening 618. Such interior slots 1401 result in a continuous outer circumference of shroud 610, as shown, and aid in directing broken lines interiorly when the shroud 610 is lowered and contacts a line. The interior slots 1401 are especially effective in combination with a cyclical rotation of shroud 610 of about 180 degrees.

In the above-described embodiments attention to accurately documented well bore tolerance measures and manufacture of shrouds to the proper clearances and assembled space-outs is important, as is developing following well bore specific running procedures during field operations. For example, shear pin connections should be fully qualified through full-scale testing prior to running in a well to ensure downhole shear valves are fully qualified.

In some embodiments, either or both the inner and outer shrouds are disengaged from the work strings that transport them in the well and land them in contact with the fish. In such examples, commonly employed mechanical "J-Latch" type tools or hydraulic release connectors that are activated by surface controls or dropping a ball or dart are used, as are commonly understood by those of skill in the art. Alternatively, mechanical shear mechanisms that shear the shroud off by means of applying increase work string weight to a shear-pinned shroud connection may be used, as may all standard oil field means of running tools, activating tools as well as retrieving tools. It should be noted that if the shrouds fail to function as planned, they can be retrieved using the same running tools as they were landed with, or they can be fished with conventional grapples or fishing profile tools.

Those of skill in the art will also understand without further disclosure that the pulling operation may be performed with a conventional drilling rig, a completion and intervention (i.e., "workover") rig, a hydraulic workover rig ("HWO"), a snubbing unit, and the like. Any such devices may be fixed platform or floating, drill ship, semi-submersible, anchored or dynamically positioned, and they may be assisted by using downhole tools to enhance their pulling power (e.g., "hydraulic jars" that can apply huge impact loads to the material to be recovered in either the upward or downward direction, and/or "hydraulic accelerator tools" that work in unison with hydraulic jars to develop additional downhole impulse type tensile (pulling) or compressional (pushing) loads.

Although illustrated as a fishing operation for a failure near the well bore surface, the invention includes operations on deeper well bore failures. Further, the specific shapes and sizes of the various components described above will change, depending on the size of the well, the depth of the fish, the shape of the fish, the type and number of lines, and other parameters that will occur to those of skill in the art.

The above description is given by way of example only. Other examples of the invention will occur to those reading the current document that are within the scope of the invention—whose scope is not intended to be limited by any statement or specific example given above. The scope of the patent is intended to be defined only by the claims that follow.

What is claimed is:

1. A method of retrieval of material, having broken lines of a length above the material, from a cased well, the method comprising:

a. lowering, into the well, an outer shroud having a lower bell-mouthed end having a uniform and continuous outer circumference, wherein the outer diameter of the lower bell-mouthed end is sized to the inner diameter of the casing of the well and the broken lines such that the gap between the casing and the lower bell-mouthed end is less than the thickness of the lines;

b. covering at least a portion of the material to be retrieved with the shroud;

c. inserting a separate inner shroud inside the outer shroud wherein said inner shroud prevents all broken lines from entering its internal bore by its guidance of the broken lines to an annulus created between the inner shroud and the outer shroud, wherein the annulus defined between the inner shroud and the outer shroud is a length sufficient to isolate the broken lines that reside above the material to be retrieved wholly within the annulus, wherein the inner shroud bore defines a substantially axial work passage through the interior of the inner shroud;

d. grasping the material to be removed through the substantially axial work passage; and e. pulling the material to be retrieved from the well.

2. A method as in claim 1, further comprising resting the outer shroud on the material to be retrieved.

3. A method as in claim 1 wherein said inserting the inner shroud inside the outer shroud and the broken lines comprises:

lowering, though the outer shroud, the inner shroud, wherein the inner shroud is sized to be longer than the length of any of the broken lines above the material to be retrieved;

contacting the outer shroud that is resting on the material to be retrieved with the inner shroud; and wherein the broken lines are isolated from the interior of the inner shroud and located in the annulus between the inner shroud and the outer shroud.

4. A system of retrieval of material from a cased well having broken lines above the material, the system comprising:

a generally-cylindrically-shaped member having substantially-radially-projecting members in an interior positioned to centralize the material to be removed, thereby defining a substantially axial work passage that is isolated from all of the broken lines;

a resting surface positioned in the cylindrical shape to rest on the material to be retrieved;

means for grasping the material to be retrieved through the substantially axial work passage;

means for pulling the material to be retrieved from the well; and means for isolating lines from the substantially axial work passage.

5. A system as in claim 4, wherein the resting surface comprises a first landing surface on at least one of said substantially-radially-projecting members wherein said first landing surface faces, at least in part, toward a bell-mouthed opening of the generally-cylindrically-shaped member.

6. A system as in claim 5, further comprising:

a tapered surface on at least one of said substantially-radially-projecting members extending from the inner diameter of said generally-cylindrically-shaped member to said landing surface;

a second landing surface on at least one of said substantially-radially-projecting members wherein said second landing surface faces, at least in part, away from said bell-mouthed opening.

7. A system as in claim 6, wherein said generally-cylindrically-shaped member includes a threaded opening on the end opposite the bell-mouthed opening.

8. A system as in claim 7, further comprising at least one guide surface located on the outside of the generally-cylindrically-shaped member between the threaded opening and the bell-mouthed opening.

9. A system of retrieval of material from a cased well having broken lines above the material, the system comprising:

means for isolating, from the well casing, the broken lines above the material to be retrieved, thereby defining a substantially axial work passage that is isolated from all of the broken lines;

means for grasping the material to be retrieved through the substantially axial work passage;

means for pulling the material to be retrieved from the well;

a tapered probe-body that has at least one passage for allowing circulation fluid to circulate in the well and a solid end for deflection of the broken lines, and an inner shroud, detachably connected to the tapered probe, the tapered probe including a connection end that includes a fluid circulation opening for connection with a work string; and means for isolating lines from the substantially axial work passage.

10. A system as in claim 9, further comprising a means for mechanically releasing, downhole, the inner shroud from the tapered probe.

11. A shroud system for isolating broken lines above a broken tool in a cased well bore comprising:

a generally cylindrically-shaped member that includes:

a bell-mouthed opening on one end having a uniform and continuous outer circumference;

a threaded opening on the other end;

substantially-radially-projecting members in the interior positioned and arranged to centralize the broken tool, a first landing surface on at least one of said substantially-radially-projecting members and wherein said first landing surfaces faces, at least in part, toward said bell-mouthed opening;

a tapered surface on at least one of said substantially-radially-projecting members extending from the inner diameter of said substantially-cylindrical-shaped member to said landing surface; and a second landing surface on at least one of said substantially-radially-projecting members wherein said second landing surface faces, at least in part, said threaded opening.

12. A shroud system as in claim 11, further comprising at least one guide surface located on the outside of the generally-cylindrically-shaped member between the threaded opening and the bell-mouthed opening, positioned to guide the generally-cylindrically-shaped member as it descends in the well bore.

13. A shroud system as in claim 12, further comprising:

a tapered probe-body that has at least one passage for allowing circulation fluid to circulate in the well and a solid end for deflection of the broken lines, and an inner shroud, detachably connected to the tapered probe, the tapered probe including a connection end that includes a fluid circulation opening for connection with a work string.

14. A system as in claim 13, wherein the inner shroud is connected to the tapered probe with a down-hole, mechanical release.

15. A system as in claim 14, wherein said down-hole, mechanical release comprises at least one shear pin.

16. A system as in claim 14, further comprising a substantially-radially-facing surface on said substantially-radially-projecting members.

* * * * *